US005080031A

United States Patent [19]

Suzuki et al.

[11] Patent Number: 5,080,031

[45] Date of Patent: Jan. 14, 1992

[54] NEEDLE THREAD HOLDING DEVICE IN SEWING MACHINE

[75] Inventors: Hajime Suzuki, Nagoya; Kazuhisa Ito, Aichi, both of Japan

[73] Assignee: Brother Kogyo Kabushiki Kaisha, Aichi, Japan

[21] Appl. No.: 570,020

[22] Filed: Aug. 20, 1990

[30] Foreign Application Priority Data

Sep. 4, 1989 [JP] Japan ..... 1-228756

[51] Int. Cl.[5] ..... D05B 65/00

[52] U.S. Cl. ..... 112/286; 112/237; 112/121.11; 112/300

[58] Field of Search ..... 112/286, 285, 293, 292, 112/237, 235, 253, 121.11, 300

[56] References Cited

U.S. PATENT DOCUMENTS

| | | | |
|---|---|---|---|
| 1,298,786 | 4/1919 | Ray | 112/298 |
| 3,320,915 | 5/1967 | Steiner | 112/253 |
| 3,448,708 | 6/1969 | Ross | 112/253 |
| 3,601,074 | 8/1971 | Von Hagen | 112/286 |
| 3,728,978 | 4/1973 | Honda et al. | 112/292 |
| 3,747,548 | 7/1973 | Brophy et al. | 112/293 |
| 4,364,319 | 12/1982 | Niehaus et al. | 112/253 X |
| 4,459,927 | 7/1984 | Kurland et al. | 112/237 |

FOREIGN PATENT DOCUMENTS

| | | | |
|---|---|---|---|
| 57-61438 | 12/1982 | Japan . | |
| 63-275393 | 11/1988 | Japan . | |
| 2006283 | 5/1979 | United Kingdom | 112/253 |

*Primary Examiner*—Peter Nerbun
*Attorney, Agent, or Firm*—Oliff & Berridge

[57] ABSTRACT

A sewing machine having a needle thread cutting unit and a needle thread holding device for holding a cut leading end portiion of the thread drawn from an eye of a needle. The needle thread holding device includes a holding means provided at the pressure foot. The holding means is movable between a needle thread clamping position and a needle thread releasing position. The holding device also includes drive means connected to the holding means for selectively moving the holding means to one of the needle thread releasing position and the needle thread clamping position, pressure foot position detection means for detecting a position of the pressure foot, needle position detector for generating a needle position signal indicative of the upper needle position and the lower needle position, and control means connected to the pressure foot position detection means the sewing machine energization signal generating means and the needle position detector. The controlling means maintains the holding means at its thread clamping position when the pressure foot is at its non-operative position after cutting the needle thread. The controlling means also maintains the holding means at its clamp position during a predetermined number of stitches at a starting phase of a next sewing operation.

9 Claims, 8 Drawing Sheets

NEEDLE THREAD HOLDING DEVICE IN SEWING MACHINE

BACKGROUND OF THE INVENTION

The present invention relates to a needle thread holding device in a sewing machine provided with a thread cutting unit.

According to a conventional sewing machine having a thread cutting unit, a thread drawn from the lastly stitched point of a workpiece or a fabric is required to be cut when the sewing operation is terminated. In this case, if the needle thread length between a needle eye and the exact cutting point is insufficiently short, the needle thread may be easily disengaged from the eye of the needle at a start phase of a subsequent sewing operation. Therefore, the thread cutting must be made so that sufficient residual thread length can be provided between the needle eye and the exact cutting point in order to retain the thread to be still engaged with the thread hole at the start timing of the subsequent sewing operation. However, if the residual thread length is excessively long, the residual thread may be stitched in an entangled manner at the next sewing operation in a nest fashion, to thereby degrade stitching quality.

To avoid these drawbacks, a thread holding device which is adapted to hold the needle thread has been provided so as to provide optimum length of the residual needle thread at the time of thread cutting. That is, the thread holding device holds the cut end portion of the thread after the thread cutting operation in order to provide sufficiently small residual length of the thread yet preventing the thread from being disengaged from the eye of the needle in the next sewing operation. However, in the conventional thread holding device, excessively high tension may be imparted on the needle thread during a time period in which the needle thread is released from the thread holding device thereby overcoming the thread retaining force thereof in accordance with the feeding of the workpiece after the start of the subsequent sewing operation. Accordingly, a stitch balancing thread tension may be disorganized, and a stitched workpiece may be shrunk.

In another aspect, at a start timing of the sewing operation, a presser foot located at its non-operative position is moved downwardly to its operative position for depressing the workpiece onto a workpiece supporting surface of the sewing machine. However, in order to perform prompt sewing operations, prior to the depression of the workpiece by the pressure foot, the sewing machine may have been energized for starting actual stitching. In this case, however, the workpiece is not stably held. Therefore, a knot between the needle thread and a bobbin thread is not provided to cause a skip stitching. In a conventional sewing machine having an automatic pressure bar lifter, the sewing machine is energized after the workpiece is stabilizingly held by the pressure foot. However, such sequence does not meet with the prompt sewing work, and an operator may be dissatisfied with such dull sewing sequence if compared with the conventional rhythmical sewing work, i.e., sewing start prior to the complete depression of the workpiece by the pressure foot.

SUMMARY OF THE INVENTION

It is therefore, an object of the present invention to overcome the above described drawbacks and to provide an improved needle thread holding device in a sewing machine capable of providing a residual needle thread having sufficiently small length at the time of thread cutting in the terminal phase of the sewing operation yet preventing the thread from being released from an eye of a needle at the start phase of the subsequent sewing operation, and avoiding disorganized stitch balancing thread tension.

Another object of the invention is to provide such a needle thread holding device in which no skip stitch occurs even upon the energization of the sewing machine prior to an exact depression of a pressure foot against a workpiece.

These and other objects of the invention will be attained in the present invention by providing a needle thread holding device in a sewing machine, the sewing machine including a needle for passing a needle thread therethrough and having upper needle position and a lower needle position, workpiece supporting means, a pressure foot selectively movable between an operative position for pressing the workpiece onto the workpiece supporting means and a non-operative position spaced away from the workpiece, sewing machine energization signal generating means adapted to generate a sewing machine energization signal in accordance with a manipulation by an operator, a thread cutting unit for cutting threads stitched into the workpiece at a terminal phase of a sewing operation, and an improvement comprising holding means, drive means, pressure foot position detection means, and control means. The holding means is provided at the pressure foot or at a position adjacent thereto. The holding means is selectively movable between a needle thread clamping position for clamping the needle thread which has been cut by the cutting unit and a needle thread releasing position for releasing the cut needle thread. The drive means is connected to the holding means for selectively moving the holding means to one of the needle thread releasing position and the needle thread clamping position. The pressure foot position detection means is provided for detecting a position of the pressure foot and for generating a signal indicative of the non-operative position of the pressure foot. The control means is connected to the pressure foot position detection means for maintaining the holding means at its thread clamping position when the pressure foot is at its non operative position in accordance with the non-operative position signal after cutting the needle thread.

In one embodiment of the invention, the control means is also connected to the sewing machine energization signal generating means and the needle position detector for maintaining the holding means at its thread clamping position during a predetermined number of stitches at a starting phase of a next sewing operation in accordance with the sewing machine energization signal from the sewing machine energization signal generating means after cutting the needle thread and, in accordance with the needle position signal from the needle position detector.

Upon completion of the sewing operation, the pressure foot is positioned at its operative position (workpiece pressing position), and the thread stitched into the workpiece and drawn therefrom is subjected to cutting by the cutting unit while the workpiece is pressedly supported on the workpiece supporting surface. In this case, the holding means positioned at the pressure foot or at a position adjacent thereto is positioned on a standby position (thread releasing position), so that the cut needle thread is releaseably maintained.

When the pressure foot is shifted from its operative position to the non-operative position after thread cutting, the pressure foot position detection means detects the non-operative position of the pressure foot and generates the position detection signal. In response to the signal, the control means acknowledges that the pressure foot is moved away from the workpiece, and at the same time, the control means controls the drive means so that the holding means is moved from its thread release position to the thread clamping position. Accordingly, the cut needle thread is clamped by the holding means. While maintaining this clamping state, if the sewing machine energization signal is issued from the signal generating means, the control means maintains this needle thread clamping state during a predetermined number of stitches at a starting phase of the sewing operation in accordance with the needle position signal sent from the needle position detector. Thereafter, the control means controls the drive means, so that the holding means is moved from its clamping position to the thread releasing position, to thus release the needle thread from the holding means.

Therefore, even if the needle thread is subjected to cutting in such a manner that the thread length between an eye of the needle and the exact cut position is small, thread cast-off and disorganization of the stitch balancing thread tension can be obviated at the starting phase of the next sewing operation. Further, even if the new sewing operation is started prior to the complete seating of the pressure foot onto the workpiece, skip stitch can be eliminated, and a first knot is surely provided by the needle thread and the bobbin thread at the first stitch. Accordingly, prompt sewing operation is achievable for an expert operator without any sense of incongruity.

BRIEF DESCRIPTION OF THE DRAWINGS

In the drawings;

FIG. 1(*b*) is a plan view particularly showing a movable blade used in one embodiment of this invention;

FIG. 1(*c*) is a cross-sectional view showing front end portions of the movable blade and a stationary blade;

FIG. 2(*b*) is an enlarged side elevational view showing an arrangement of a pressure foot and associated movable and stationary blade and spring member.

DETAILED DESCRIPTION OF THE PREFERRED EMBODIMENTS

A needle thread holding device in a sewing machine according to one embodiment of the present invention will be described with reference to accompanying drawings.

Figure 2A:
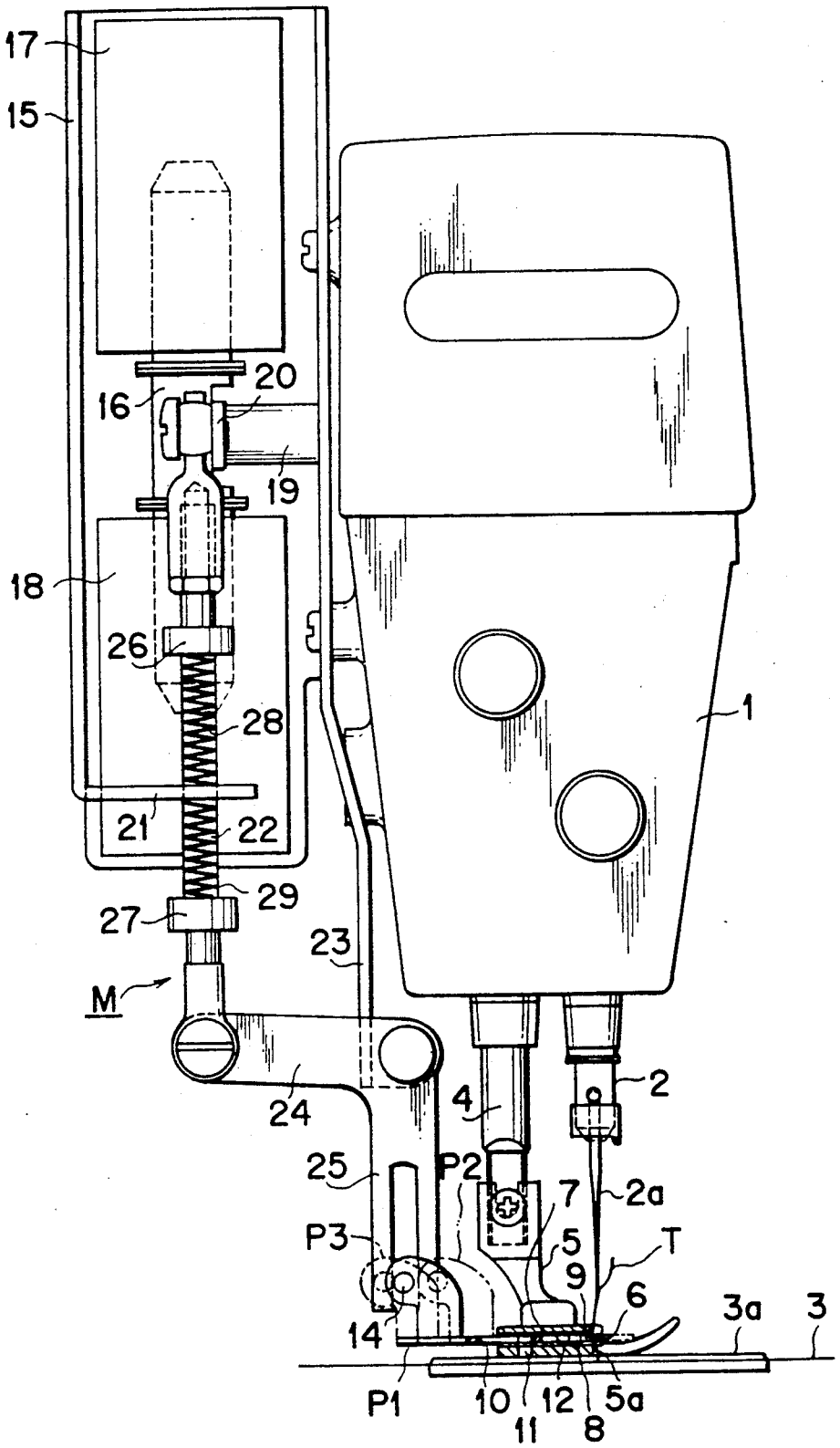
FIG. 2(*a*) is a side elevational view showing an arm portion of the sewing machine according to the embodiment of this invention.
Figure 2B:
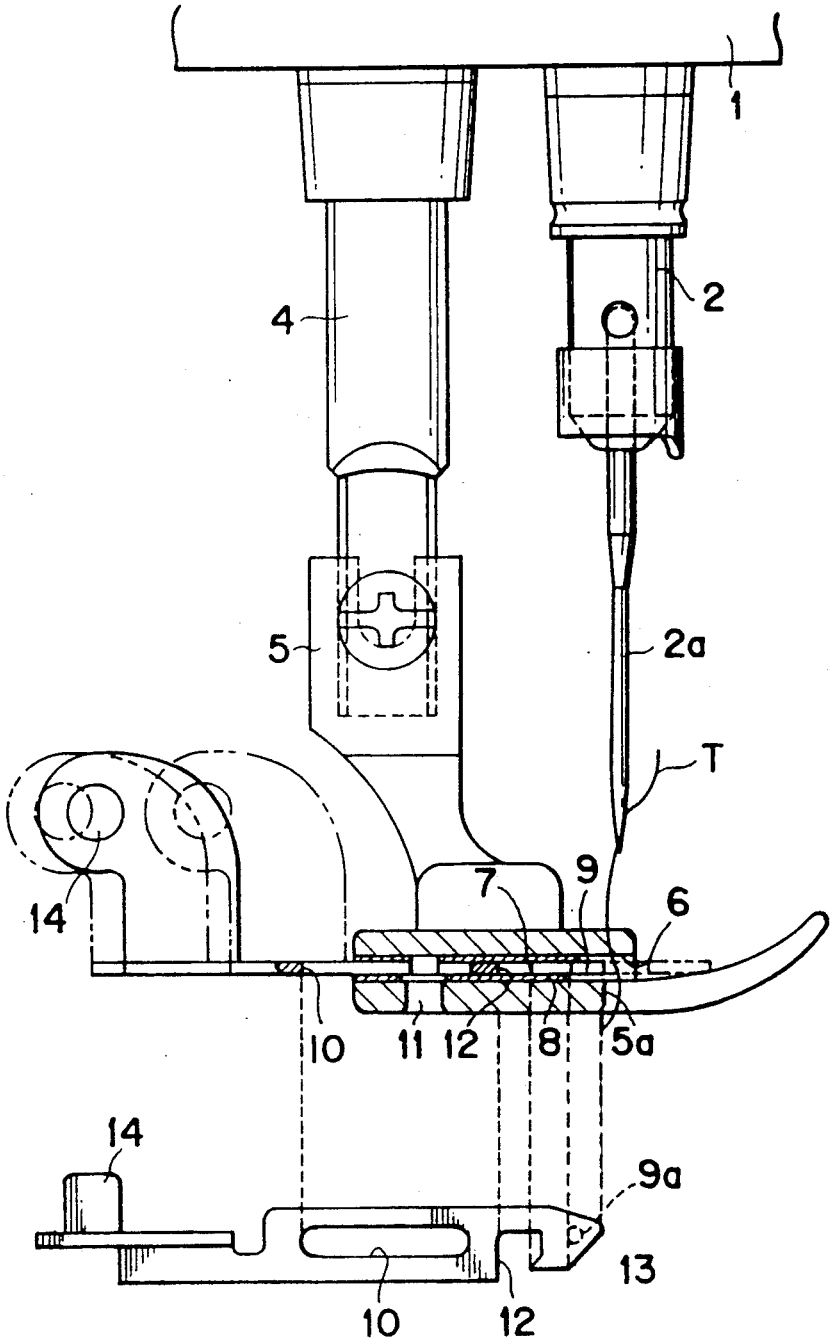
Figure 3:
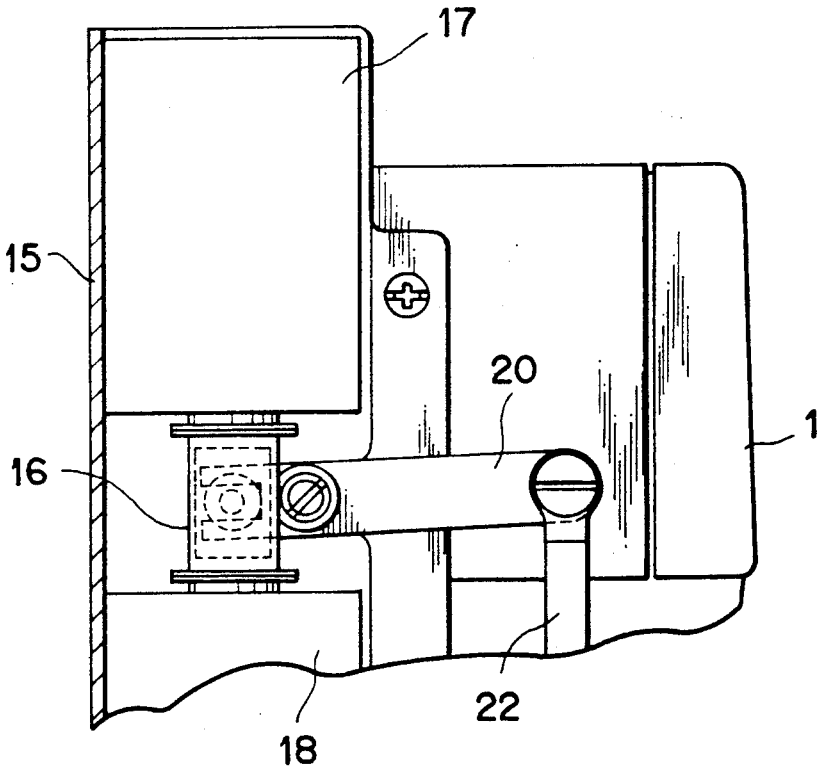
FIG. 3 is a rear partial view showing the arm portion.

In FIGS. 2(*a*) and 2(*b*), a sewing machine has an arm portion 1 which vertically movably supports a needle bar 2 whose lower end portion is attached with a needle 2*a*. The needle bar 2 is reciprocally movable in a vertical direction in synchronism with a movement of a thread trapping means (not shown) provided in a bed portion 3 in order to obtain stitching to a workpiece fabric. Further, the arm portion 1 vertically movably supports a pressure bar 4 whose lower end portion is provided with a pressure foot 5 formed with a needle passing hole 5*a*. By the vertical movement of the pressure bar 4, the pressure bar 4 has an operative position and a non operative position. In the operative position, the pressure foot 5 depresses the workpiece, at a position adjacent the needle descent position, toward a workpiece supporting surface 3*a* of the bed portion 3, whereas in the non operative position, the pressure foot 5 is moved away from the workpiece supporting surface 3*a* (the pressure foot 5 is moved upwardly).

Figure 1A:
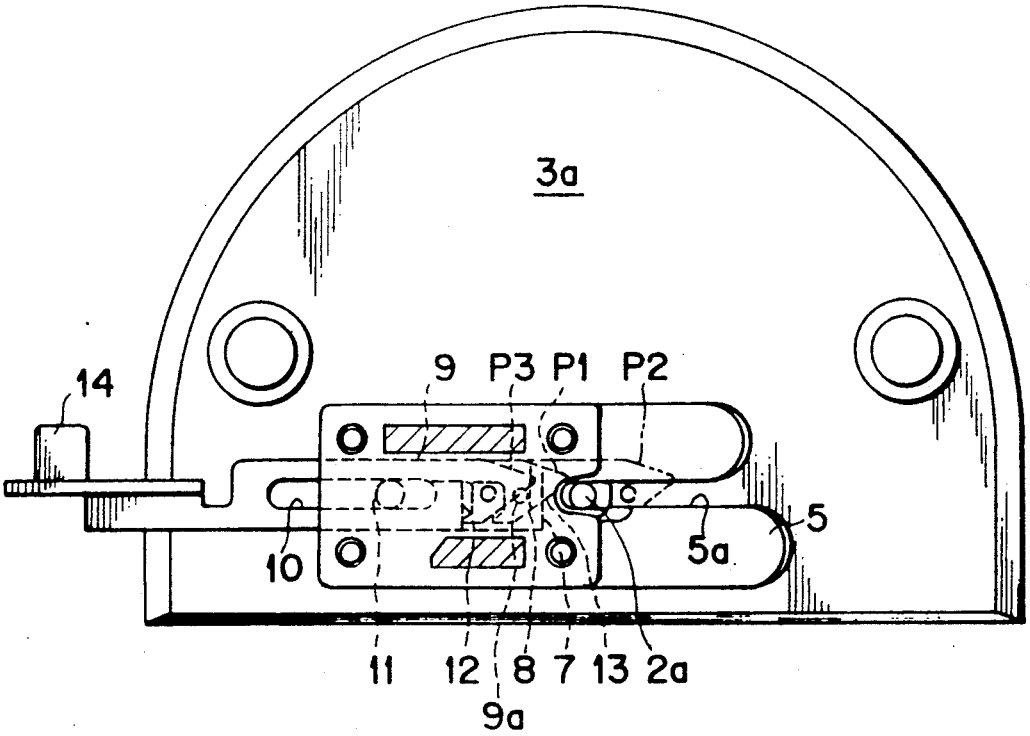
FIG. 1(*a*) is a plan view showing a pressure foot and neighboring components in a sewing machine according to one embodiment of this invention.
Figure 1B:
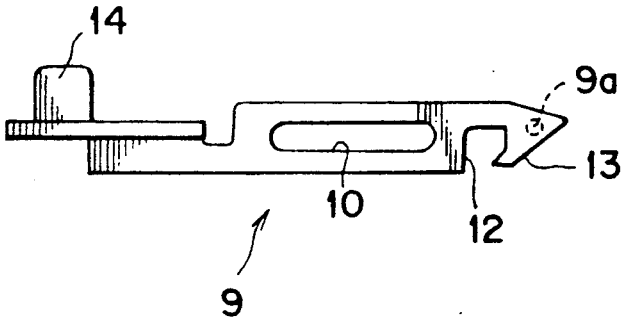
Figure 1C:
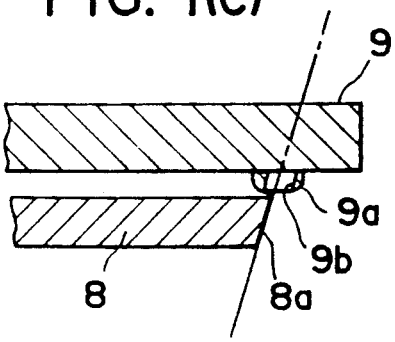

The pressure foot 5 is formed with a guide passage 6 extending in a workpiece feeding direction and in parallel with the workpiece supporting surface 3*a*. In upper and lower wall surfaces of the guide passage 6, there are provided a thread catching spring 7(rectangular shape in FIG. 1(*a*), and positioned at the upper wall surface of the passage 6 as shown in FIG. 2(*b*)) and a stationary blade 8(rectangular shape in FIG. 1(*a*) and positioned at the lower wall surface of the passage 6 as shown in FIG. 2(*b*)). Further, as shown in FIGS. 1(*b*), 1(*c*) and 2(*b*), a movable blade 9 is slidably disposed within the guide passage so as to pass through a space defined between the thread catching spring 7 and the stationary blade 8. The movable blade 9 has an intermediate portion formed with an elongated slot 10, and the pressure foot 5 is provided with a pin 11 which extends through the slot 10. By the engagement between the pin 11 and the slot 10, slidable moving range of the movable blade 9 is defined. The thread catching spring 7 is adapted to tightly hold a leading end portion of the needle thread which has been cut by the blades at a position between the movable blade and the thread catching spring 7. One end portion (rightmost edge portion) of the thread catching spring 7 is positioned more rightwardly than a rightmost end portion of the stationary blade 8 as shown in FIG. 1(*a*), whereas leftmost edge portions of the spring 7 and the blade 8 are aligned with each other as shown in FIG. 2(*b*).

Further, as shown in FIGS. 1(*b*) and 1(*c*), the movable blade 9 has a front portion provided with a blade edge 9*a*, a notched portion 12 and a thread handling portion 13, and has a rear portion provided with a linking pin 14 protruded therefrom. The blade edge 9*a* is adapted to cut the needle thread T passing through the eye of the needle 2*a* in cooperation with the stationary blade 8.

More specifically, as best shown in FIG. 1(*c*), the movable blade edge 9*a* has a frusto-semi-spherical and hollow shape obliquely extending downwardly from a lower surface of the movable blade body. That is, a hollow portion 9*b* is formed in the blade edge 9*a* so as to provide an acute edge, and an axis of the hollow portion 9*b* extends obliquely as shown in FIG. 1(*c*). Further, the stationary blade 8 has a tip end face 8*b* which is slanted in a direction parallel to the axis of the hollow portion 9*b* of the blade edge 9*a*.

The notched portion 12 is adapted for trapping the needle thread, and the thread handling portion 13 is adapted to direct the needle thread T into the notched portion 12 along its slanting edge when the movable blade 9 is moved leftwardly in FIG. 1(*a*).

As shown in FIGS. 1(*a*) through 2(*b*), the movable blade 9 has a standby or a thread releaseable position P1 shown by a solid line. In this standby state, the thread handling portion 13 is positioned at one side (left side in FIG. 2(*a*)) of and adjacent to the needle passing hole 5*a*. Further, the movable blade 9 has a trapping position P2 shown by a broken line where the thread handling portion 13 moves across the needle passing hole 5*a* to be placed on another side (right side in FIG. 2(*a*)). Furthermore, the movable blade 9 has a thread cutting position or thread clamping position P3 where the blade edge 9*a* engages the stationary blade 8 and at the same time the blade slidably moves (moves leftwardly in FIG. 2(*a*)) over the thread catching spring 7 for clamping the cut thread between the movable blade 9 and the spring 7.

As shown in FIGS. 2(*a*), 2(*b*) and 3, a bracket 15 is fixedly attached to a rear face of the arm portion 1, and a needle thread trapping solenoid 17 and a needle thread cutting solenoid 18 are mounted in a vertical orientation on the bracket 15 with a predetermined space therebetween. These solenoids 17 and 18 have a compatible or a commonly used plunger 16. In the vicinity of the plunger 16, a supporting plate 19 extends from the bracket 15 for pivotably supporting an intermediate portion of a connecting lever 20 and one end of the connecting lever 20 is connected to the plunger 16. Further, a supporting piece 21 also extends from the bracket 15, and an operation shaft 22 vertically movably passes through the supporting piece 21. One end (upper end in FIGS. 2(*a*) and 2(*b*)) of the operation shaft 22 is pivotally connected to another end of the connecting lever 20.

A supporting arm 23 is fixed to the bracket 15, and an intermediate portion of a L-shaped intermediate lever 24 is pivotably connected to the supporting arm 23. The L-shaped intermediate lever 24 has a rear arm portion 24 pivotably connected to another end (lower end) of the operation shaft 22, and has a bifurcated portion 25 engageable with the linking pin 14 protruding from the movable blade 9. Further, a pair of upper and lower adjusting nuts 26 and 27 are threadingly engaged with the operation shaft 22 at opposite sides with respect to the supporting piece 21, and a first coil spring 28 is disposed over the operation shaft 22 between the upper nut 26 and the supporting piece 21. A second coil spring 29 is also provided between the lower nut 27 and the supporting piece 21. By changing engagement positions of the adjusting nuts 26 and 27, biasing forces of the coil springs 28 and 29 can be controlled.

With the structure of the arm portion 1, when the both solenoids 17 and 18 are held in deenergized states, the movable blade 9 has the standby or thread releasable position P1 shown by the solid line because of the balancing of the biasing forces of the two coil springs 28 and 29 through the operation shaft 22 and the intermediate lever 24. In this state, the thread handling portion 13 at the front end of the movable blade 9 is positioned at the left side of the needle passing hole 5*a* as described above. On the other hand, upon only energization of the upper solenoid 17, i.e., the needle thread trapping solenoid 17, the plunger 16 is moved upwardly, so that the operation shaft 22 is moved downwardly through the connecting lever 20 to angularly rotate the L-shaped intermediate lever 24 in a counterclockwise direction in FIGS. 2(*a*) and 2(*b*), to thereby move the movable blade 9 rightwardly through the linking pin 14. As a result, the thread handling portion 13 moves across the needle passing hole 5*a* to have the thread trapping position P2.

Furthermore, upon only energization of the lower solenoid 18, i.e., the needle thread cutting solenoid 18, the plunger 16 is moved downwardly, so that the movable blade 9 is slidably moved leftwardly in FIGS. 1(*a*), 1(*b*) and 1(*c*) through the connecting lever 20, the operation shaft 22 and the intermediate lever 24. Therefore, the blade edge 9*a* engages the stationary blade 8, and has the cutting or thread clamping position P3 where the blade 9 is slidingly moved with respect to the thread catching spring 7.

In the above structure, the thread catching spring 7 and the movable blade 9 constitute a holding means, and the solenoids 17, 18, the connecting lever 20, the operation shaft 22, the intermediate lever 24 and the coil springs 28 29 constitute a drive means M which performs positional switching of the holding means between the cutting or thread clamping position P3 and the standby or thread release position P1.

Figure 4:
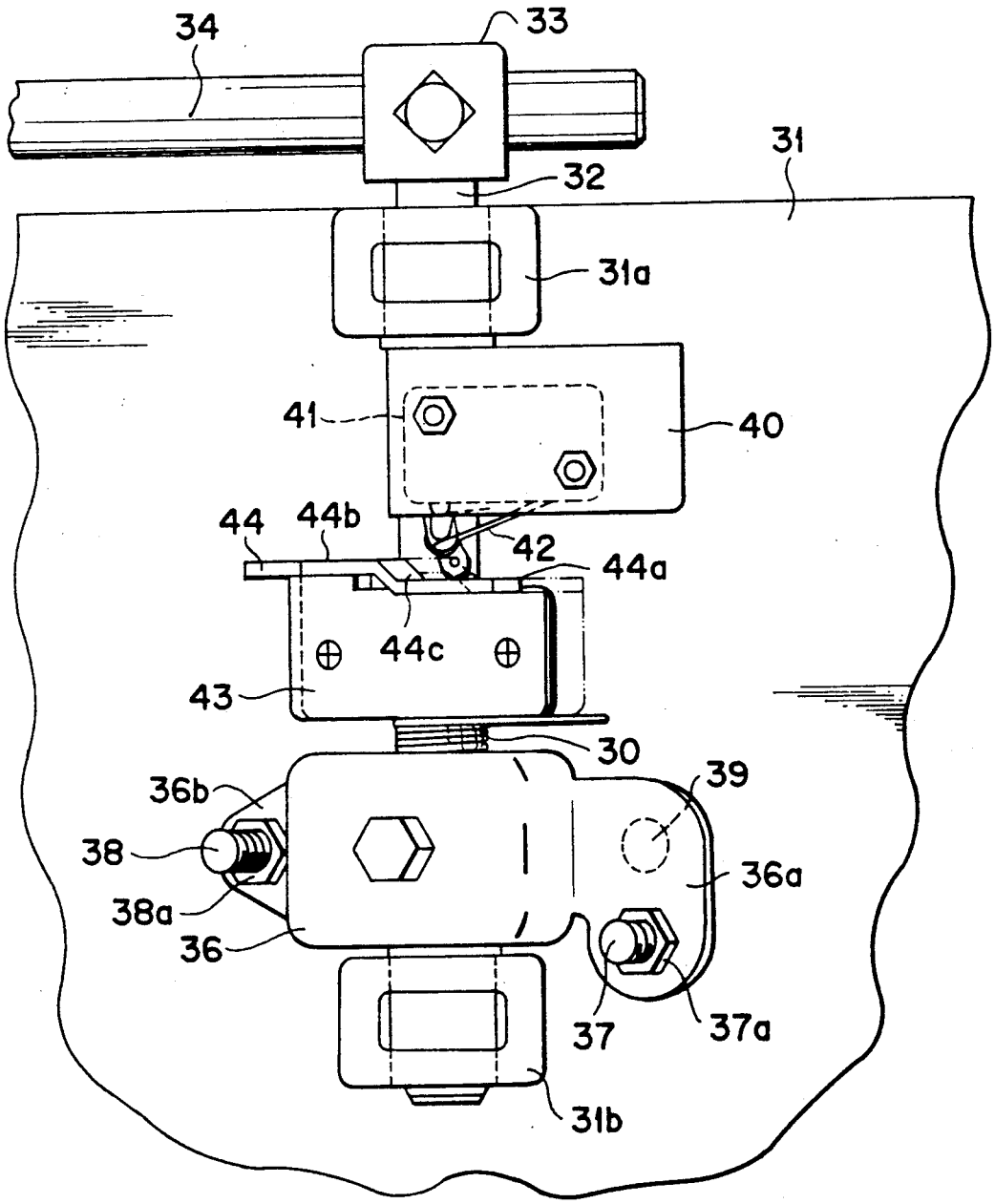
FIG. 4 is a partial bottom view showing a pressure foot operation mechanism according to the embodiment of this invention.
Figure 5:
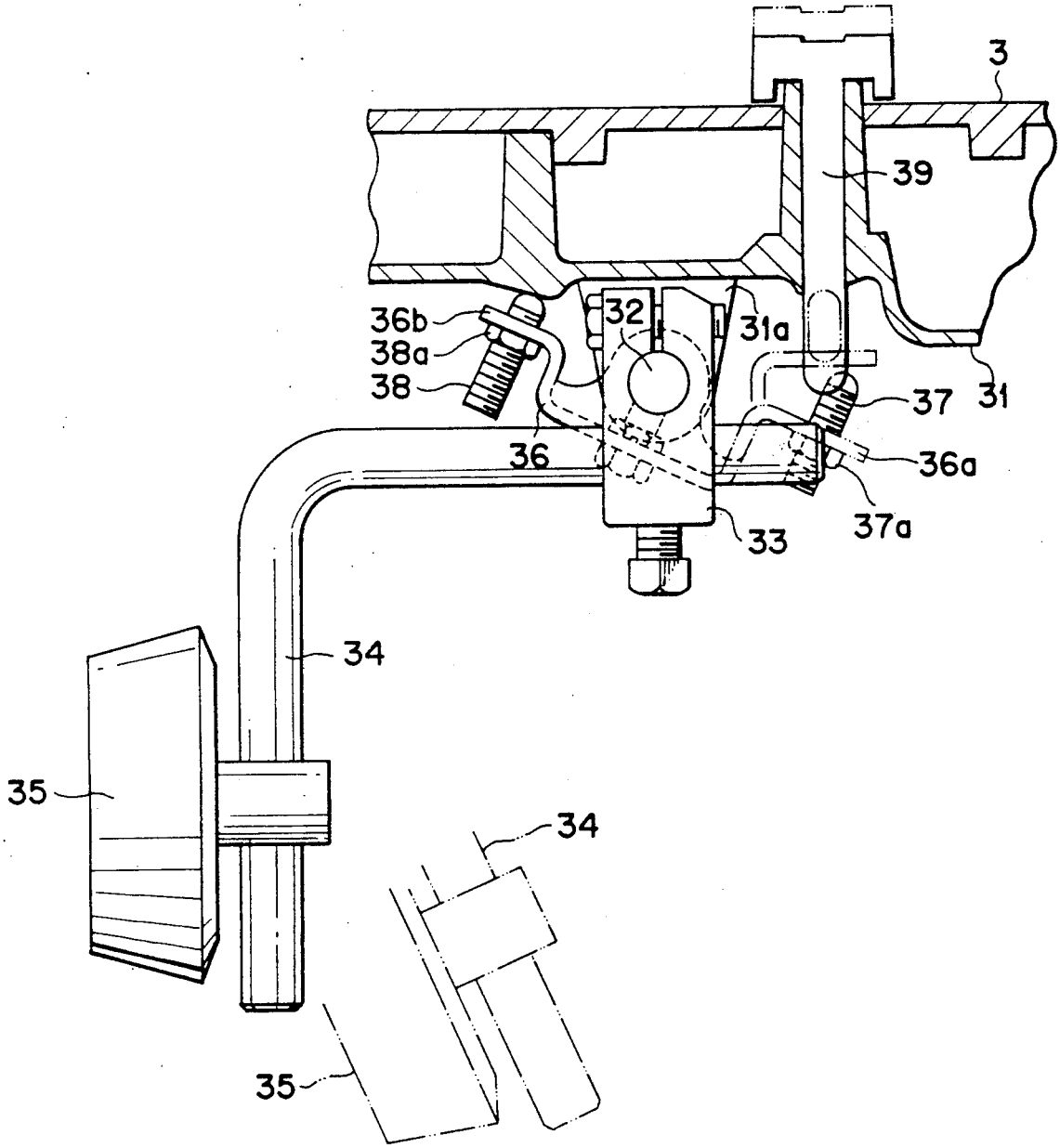
FIG. 5 is a partial front view showing the arm portion.

As shown in FIGS. 4 and 5, an oil pan 31 is disposed below the bed portion 3 for accumulating lubricating oil so as to supply the oil to various mechanical components of the sewing machine. The oil pan 31 is provided with a manipulation mechanism for manipulating the vertical motion of the pressure foot 5 by a knee.

As best shown in FIG. 5, an operation rod 39 is provided which is vertically movable and extends through the oil pan 31. The operation rod 39 is operatively coupled to the pressure foot through a conventional linking mechanism (not shown). The operation rod 39 has a descent position shown by a solid line in FIG. 5 where the pressure foot 5 has an operative position through the linking mechanism. The operation rod 39 has an ascent position shown by two dotted chain line in FIG. 5 where the pressure foot 5 has a non-operative position.

Further, as shown in FIG. 4, a pair of shaft holders 31*a*, 31*b* protrude from a bottom surface of the oil pan 31 with a space therebetween, and a rotatable shaft 32 is rotatably supported by the shaft holders 31*a*, 31*b*. As shown in FIGS. 4 and 5, one end of the rotatable shaft 32 is integrally connected to one end portion of an inverted L shaped manipulation member 34 through a coupling segment 33, so that the manipulation member 34 is pivotably movable about an axis of the rotatable shaft 32 in response to the rotation thereof. The manipulation member 34 has another end provided with a knee pad 35.

An operation segment 36 is provided integral with the rotatable shaft 32 and at a position adjacent to the one of the shaft holders 31*b*. As best shown in FIG. 5, the operation segment 36 is provided with wings 36*a* and 36*b* extending perpendicular to the axial direction of the rotatable shaft 32, and rotation regulating shafts 37 and 38 are threadingly engaged with the wings 36*a* and 36*b*, respectively. One of the wings 36*a* is abuttable on a bottom planar end of the operation rod 39. Tip ends of the rotation regulating shafts 37 and 38 are abuttable on the bottom face of the oil pan 31 for restricting or regulating rotation amount of the rotatable shaft 32 For this, adjusting nuts 37*a* and 38*a* are threadingly engaged with the rotation regulating shafts 37 and 38, respectively for adjusting threading advancing length thereof, to thereby control vertically moving stroke length of the operation rod 39.

A torsion spring 30 is disposed over the rotatable shaft 32 for normally urging the one of the rotation regulating shafts 38 toward the oil pan 31. In this state, the operation rod 39 has a descent position where the wing 36*a* is positioned away from the rod 39, and the inverted L-shaped manipulation member 34 has a standby position shown by a solid line in FIG. 5. On the other hand, if the knee pad 35 is depressed against the biasing force of the torsion spring 30, the member 34 is angularly moved about the axis of the rotatable shaft 32 to obtain a manipulating position shown by a two dotted chain line in FIG. 5. In this case, the wing 36*a* is brought into contact with the bottom end face of the operation rod 39, and the latter is urged upwardly to have its ascent position shown by a broken line in FIG. 5. Further, the rotation regulating shaft 37 is brought into abutment with the oil pan 31 for restraining further angular rotational movement of the manipulation member 34.

Moreover, as shown in FIG. 4, one of the shaft holders 31*a* is provided with a switch table 40 on which a microswitch 41 is attached as detection means. The microswitch 41 has a contact lever 42 whose tip end portion is provided with a roller. In accordance with opening and closing motion of the contact lever 42, a pressure bar lift signal is generated. On the other hand, at a position adjacent the switch table 40, an actuation piece 43 is provided integral with the rotatable shaft 32, so that the actuation piece 43 is also angularly rotatable together with the angular rotation of the shaft 32. The actuation piece 43 is formed with a cam portion 44 which includes a pair of flat portions 44*a*, 44*b* whose heights of camming surfaces are different from each other and an inclined portion 44*c* connecting between the two flat cam portions 44*a* and 44*b*.

When the manipulation member 34 is held at its standby position shown by the solid line in FIG. 5, one of the flat cam surface portions 44*a* of the cam portion 44 of the actuation piece 34 is engaged with the roller of the contact lever 42 as shown by a solid line in FIG. 4. On the other hand, when the manipulation member 34 is angularly moved to its manipulating position shown by the two dotted chain line in FIG. 5, the roller of the contact lever 42 is successively brought into engagement with the inclined portion 44*c* and the other flat portion 44*b* because of the angular rotation of the actuating piece 43 as shown by a two dotted chain line in FIG. 4, prior to the abutment of the wing 36*a* against the operation rod 39. By the successive engagement of the roller with the inclined and second flat cam surfaces 44*c* and 44*b*, the contact lever 42 is depressed, so that the microswitch 41 generates the pressure bar lift signal. Incidentally, in FIG. 5, switch table 40, the microswitch 41 and the actuation piece 43 are not delineated for better understanding of the construction.

Figure 6:
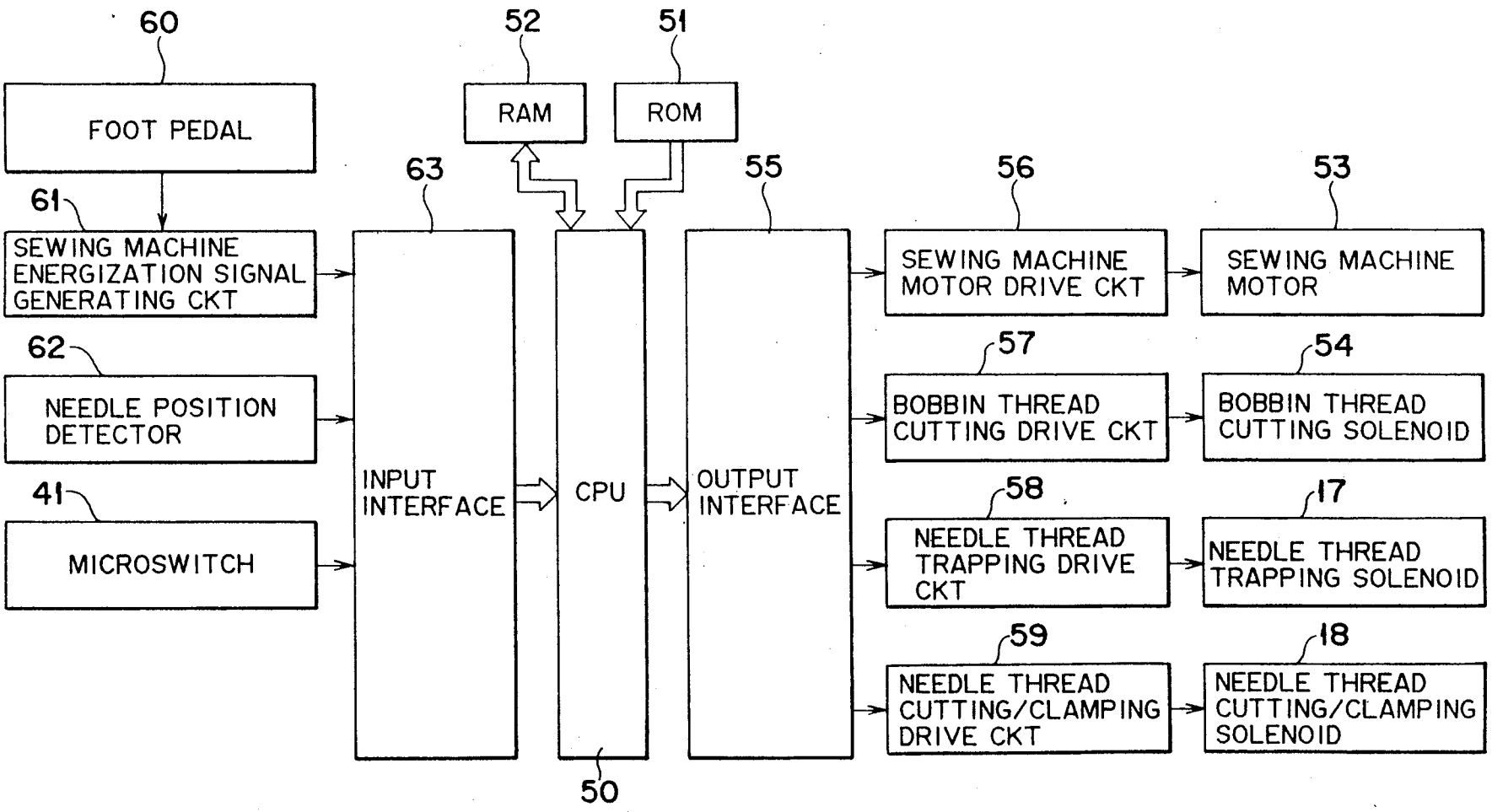
FIG. 6 is a block diagram showing a control means of the sewing machine according to one embodiment of this invention.

Next, an electrical construction in the sewing machine of this invention will be described with reference to FIG. 6.

A central processing circuit (CPU) 50 constitutes a control means to which a read only memory (ROM) 51 and a random access memory (RAM) 52 are connected. Stored in the ROM 51 is an overall operation program for controlling overall operation of the sewing machine. Further, in the RAM 52, various data is stored for controlling driving or energization of the sewing machine.

An output interface 55 is connected to the CPU 50, and a sewing machine motor 53 for driving the sewing machine is connected to the interface 55 through a sewing machine motor driving circuit 56. A bobbin thread cutting solenoid 54 is connected to the output interface through a bobbin thread cutting drive circuit 57 for connecting the bobbin thread cutting unit to a drive source. Further, the above described needle thread trapping solenoid 17 and the needle thread cutting solenoid 18 are connected to the output interface 55 through a needle thread trapping drive circuit 58 and a needle thread cutting drive circuit 59, respectively. Thus, CPU 50 sends control signals to the motor 53 and the solenoids 54, 17, 18 such as sewing machine drive signal, bobbin thread cutting signal, needle thread trapping signal and needle thread cutting signal.

Further, CPU 50 is connected to an input interface 63 to which is connected a sewing machine energization signal generating circuit 61 which generates such a signal in accordance with a pedaling condition of a foot pedal 60. Further, the input interface 63 is connected to a needle position detector 62 which detects upper and lower needle positions for generating an upper needle position signal and a lower needle position signal. Furthermore, the above described microswitch 41 is also connected to the CPU through the input interface 63. In response to foot pedal-in and pedal-return motions of the foot pedal 60, the sewing machine energization signal generating circuit 61 generates a pedal-in and pedal-return signals, and these signals are transmitted to the CPU 50. Moreover, an upper needle position signal and lower needle position signal are transmitted from the needle position detector 62 into the CPU 50, and the above described pressure bar lift signal is transmitted from the microswitch 41 into the CPU 50.

Figure 7:
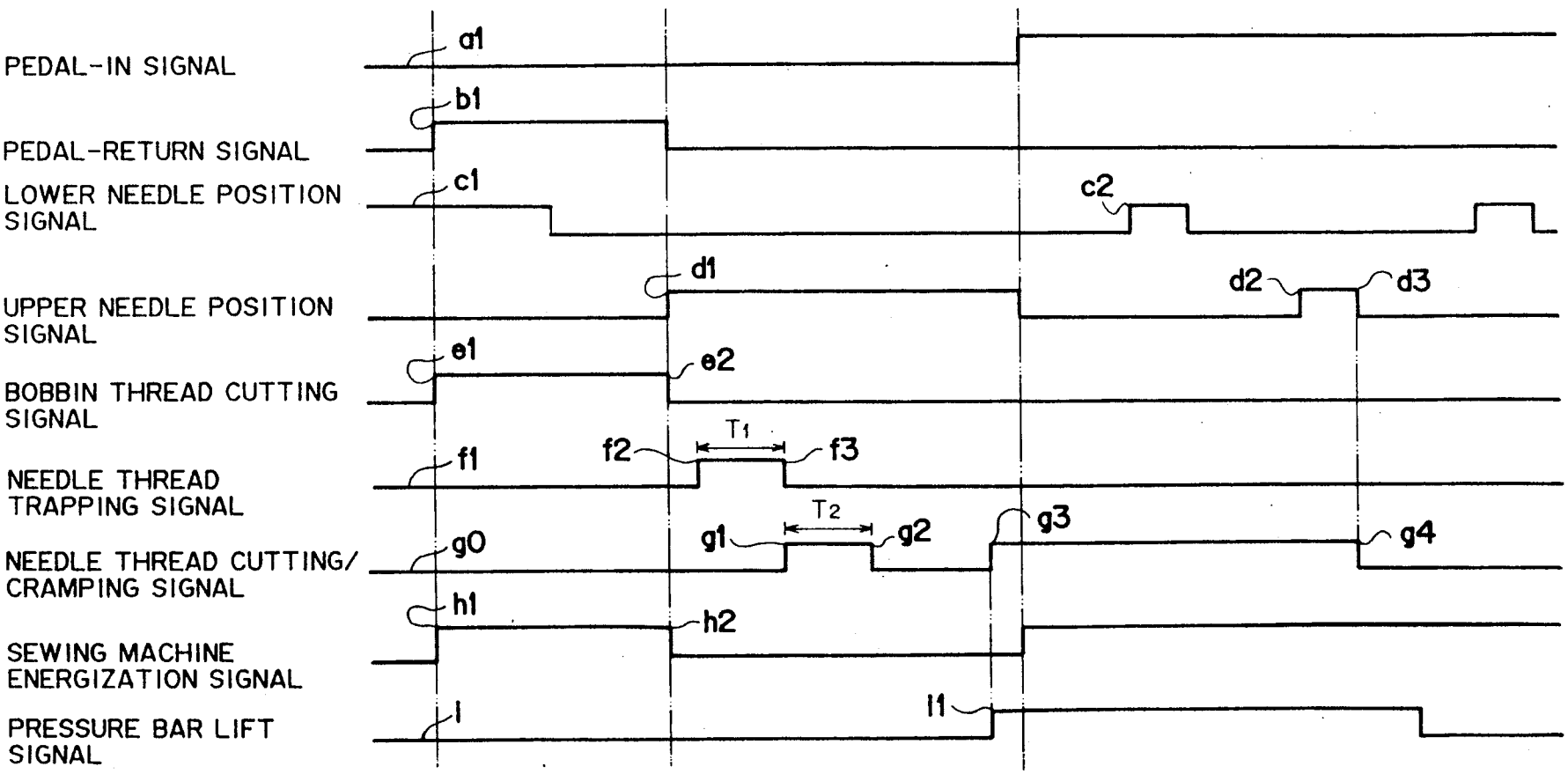
FIG. 7 is a timing chart for description of operational timed relationship among various signals.

With the structure, thus organized, operation sequence in the sewing machine will next be described with reference to a timing chart shown in FIG. 7.

During operational state of the sewing machine based on the forward pedal-in of the foot pedal 60, the needle thread trapping solenoid 17 and the needle thread cutting solenoid 18 are controlled to be in deenergized states(f1, g1) by the CPU 50. As a result, the movable blade 9 is held at its standby position P1 shown in FIG. 1(*a*) through the linking lever 20, the operating shaft 22 and the intermediate lever 24. When predetermined stitching work is terminated, the needle 2*a* is stopped at its lower needle position (c1)

If the thread cutting is to be carried out with the lower needle position, a pedal return signal is inputted into the CPU 50 (b1) for starting the thread cutting operation upon return pedaling of the foot pedal 60. In response to this signal (b1), the CPU 50 outputs the sewing machine drive signal (h1) to the sewing machine motor 53 so as to operate the sewing machine at a low speed. At the same time, the CPU 50 generates the bobbin thread cutting signal (e1) so as to interposedly cut the bobbin thread between the thread trapping unit (not shown) and the workpiece.

After time elapse of the continuous low speed operation of the sewing machine, the needle position detector 62 transmits the upper needle position signal (d1) to the CPU 50. In response to this signal, the CPU 50 stops sending the sewing machine drive signal (h2) and the bobbin thread cutting signal (e2) so as to stop rotation of the sewing machine motor 53 and to deenergize the bobbin thread cutting solenoid 54.

Subsequently, the CPU 50 has a standby state for about 20 ms, and then, the needle thread trapping solenoid 17 is energized (f2) for a predetermined period T1. In accordance with the energization of the solenoid 17, the plunger 16 is moved upwardly, so that the movable blade 9 is moved from its standby position P1 to the trapping position P2 through the linking lever 20, the operation shaft 22 and the intermediate lever 24. By this movement, the needle thread T is guided into the notched portion 12 by means of the thread handling portion 13.

After elapse of the predetermined period T1, the needle thread trapping solenoid 17 is deenergized (f3) and simultaneously, the needle thread cutting solenoid 18 is energized (g1) for a predetermined period T2. By this energization, the plunger 16 is moved downwardly, so that the movable blade 9 is slidingly moved from its trapping position P2 to the cutting or thread clamping position P3. Accordingly, the blade edge 9*a* of the movable blade 9 is brought into engagement with the stationary blade 8, to thereby cut the needle thread T. The cut end of the thread (which thread is not the cut away thread but the thread still engaged with the eye of the needle) is tightly held between the movable blade 9 and the thread catching spring 7.

After elapse of the predetermined period T2, the needle thread cutting solenoid 18 is deenergized (g2) by the CPU 50. In response to the deenergization, the movable blade 9 is slidingly moved from its cutting position P3 to its standby position P1. In this sliding movement of the movable blade 9, the cut end portion of the thread T (a leading end portion) is still held by the movable blade 9 and the thread catching spring 7 with a holding force smaller than the force applied by the blade 9 and the spring 7 when the blade 9 is positioned at the thread cutting position P3. Thus, the needle thread clamping operation is completed.

Therefore, according to the needle thread holding device of this invention, after the needle thread is subjected to cutting on the pressure foot 5 positioned at its operative position, the cut leading end portion of the needle thread is held by the pressure foot 5. Accordingly, residual length of the needle thread suspended from the eye of the needle 2*a* can be reduced after cutting, and further, release of the residual thread from the needle eye can be obviated.

According to the present invention, if the workpiece is to be replaced by a new workpiece for the next sewing, the manipulation member 34, the rotatable shaft 32, the operation segment 36 and the actuation piece 43 are integrally angularly rotated in a counterclockwise direction (FIG. 5) upon depression of the knee pad 35. By the angular rotation, the contact lever 42 of the microswitch 41 is depressed by the actuation piece 43 before the wing 36*b* of the operation segment 36 abuts the lower end face of the operation rod 39. Therefore, the microswitch 41 generates the pressure bar lift signal (il). In response to the signal, the CPU 50 will again energize the needle thread cutting solenoid 18 (g3) so as to again move the movable blade 9 from its standby position P1 to the thread clamping position P3. Accordingly, the cut end portion of the needle thread is firmly held by the movable blade 9 and the thread catching spring 7. After the firm holding of the thread, the pressure foot 5 is displaced from its operative position to its non operative position in accordance with the lifting operation of the operation rod 39 by the wing 36*a*. As described above, the pressure foot 5 is connected to the operation rod 39 by way of the linking mechanism (not shown.

While maintaining the non-operative position of the pressure foot 5, the workpiece is replaced by a new workpiece, and thereafter, the new stitching to the new workpiece is intended to be started. In this case, an ordinary operator may start the stitching by pedaling-in the foot pedal 60 simultaneous with the release of her knee from the knee pad 35 in an attempt to perform prompt sewing work. However, it takes several time periods for completely recovering the operative position of the pressure foot 5 after the release of the knee from the knee pad 35, since mechanical power transmission from the manipulation member 34 to the pressure foot 5 requires several time periods due to various interlinkage of the mechanical segments such as the components 32, 36 and due to mechanical interference between the microswitch 42 and the actuation piece 43. Consequently, the actual sewing work is started at a timing earlier than the actual depression timing of the pressure foot 5 onto the workpiece. Due to this time lag, conventionally, a knot attendant to the first stitch may not be provided.

In contrast, according to the present invention, after the input of the pressure bar lift signal into the CPU 50 and subsequent input of the pedal-in signal thereinto, the needle thread cutting solenoid 18 is maintained in its energized state (see g3 in FIG. 7) for firmly holding the cut leading end portion of the needle thread between the movable thread 9 and the thread catching spring 7 until predetermined numbers N of the respective downward needle position signal and upward needle position signal are inputted into the CPU from the needle position detector 62 (in the illustrated embodiment, N=1, see c2 and d2). Therefore, in the present invention, at the first stitch, the needle thread is not released from the eye of the needle 2*a* and a knot of the needle thread and the bobbin thread can be surely provided irrespective of the non-pressurized holding of the workpiece onto the workpiece supporting surface by the pressure foot 5, since the cut leading end portion of the needle thread is securely held between the movable blade 9 and the thread catching spring 7.

Thereafter, upon termination of the input of the N times upper needle position signal (d3), the needle thread cutting solenoid 18 is deenergized (g4), so that the movable blade 9 is returned from the thread clamping position P3 to the standby or thread releasable position P1. In this instance, the thread clamping force given by the movable blade 9 and the thread catching spring 7 is reduced. In accordance with feeding of the workpiece attendant to the continuous operation of the sewing machine, the cut leading end portion of the thread is easily released from the movable blade 9 and the thread catching spring 7, Accordingly, no abnormal or excessive tension is applied to the needle thread, to thereby provide sufficient stitch balancing thread tension.

In view of the above, in the thread holding device according to the above described embodiment, the needle thread can be cut while providing a reduced length of the residual thread from the eye of the needle 2*a*, since the thread can be cut at a pressure foot 5 which is located adjacent to the needle 2*a*. Therefore, thread entanglement or nest-like stitching is avoidable, which otherwise occurs if the residual cut needle thread has excessively large length.

Further, after cutting the needle thread, the cut leading end portion of the needle thread is firmly clamped for a period starting from a timing immediately before the lifting of the pressure foot and ending at a one stroke movement of the needle at the first stitching in the subsequent sewing operation. Accordingly, a knot of the needle thread and the bobbin thread can be provided without fail despite of the fact that the residual thread has a reduced length. If the knot attendant to the first stitch is provided, the subsequent numbers of stitches can surely be provided, since the needle thread and the bobbin thread are securely held by the workpiece by the first knot. Consequently, skip stitching and thread cast-off can be obviated even if the pressure foot 5 reaches the workpiece at a delayed timing for starting the subsequent sewing operation, and as a result high grade stitching is attainable.

Moreover, after one stroke movement of the needle 2*a*, the thread clamping force given by the movable blade 9 and the thread catching spring 7 is weakened, and accordingly, stitch balancing thread tension is not degraded, and no shrinkage occur in the workpiece.

While the invention has been described in detail and with reference to specific embodiments thereof, it would be apparent to those skilled in the art that various changes and modifications can be made therein without departing from the spirit and scope of the invention.

What is claimed is:

1. A needle thread holding device in a sewing machine, the sewing machine including a needle for passing a needle thread therethrough and having an upper needle position and a lower needle position, workpiece supporting means (3*a*) for supporting a workpiece, a pressure foot (5) selectively movable between an operative position for pressing the workpiece onto the workpiece supporting means and a non-operative position spaced away from the workpiece, sewing machine energization signal generating means (60, 61) adapted to generate a sewing machine energization signal in accordance with a manipulation by an operator, a thread cutting unit for cutting threads stitched into the workpiece at a terminal phase of a sewing operation, and an improvement comprising:

holding means (7, 9) provided in the vicinity of pressure foot (5), the holding means being selectively movable between a needle thread clamping position (P3) for clamping a needle thread which has been cut by the cutting unit and a needle thread releasing position (P1) for releasing the cut needle thread;

drive means (M) connected to the holding means (7, 9) for selectively moving the holding means to one of the needle thread releasing position (P1) and the needle thread clamping position (P3);

pressure foot position detection means (41) for detecting a position of the pressure foot (5) and generating a signal indicative of the non-operative position of the pressure foot; and control means (50) connected to the pressure foot position detection means (41) for maintaining the holding means (7, 9) at its thread clamping position (P3) when the pressure foot (5) is at its non-operative position in accordance with the non-operative position signal after cutting the needle thread.

2. The needle thread holding device as claimed in claim 1, further comprising a needle position detector (62) for generating a needle position signal indicative of the upper needle position and the lower needle position, and wherein the control means (50) is further connected to the sewing machine energization signal generating means (60,61) and the needle position detector(62 for maintaining the holding means (7, 9) at its thread clamping position (P3) during a predetermined number of stitches at a starting phase of a next sewing operation in accordance with the sewing machine energization signal from the sewing machine energization signal generating means (60, 61) after cutting the needle thread and with the needle position signal from the needle position detector (62).

3. The needle thread holding device as claimed in claim 1, wherein the holding means (7, 9) also has a thread trapping position, and wherein the drive means (M) comprises:

a first solenoid (17) energizable for moving the holding means (7, 9) to the thread trapping position;

a second solenoid (18) energizable for moving the holding means (7, 9) to the thread clamping position;

a common plunger (16) extending between the first and second solenoids;

linkage means (20,22, 24, 14) connected between the plunger (16) and the holding means (7,9); and biasing means (28, 29) for urging the holding means to the thread releasing position (P1) during deenergized states of the first and second solenoids.

4. The needle thread holding device as claimed in claim 3, wherein the pressure foot (5) is formed with a guide passage (6), and wherein the holding means comprises a movable blade (9) slidably movable in the guide passage to the thread trapping position, the thread clamping position and to the thread releasing position, and a thread catching spring (7) fixed to the guide passage and positioned above the movable blade(9), the movable blade being provided with a downwardly protruding blade edge (9*a*) and a thread handling portion (13) having a slanting surface with respect to the moving direction of the movable blade (9), and the movable blade (9) being formed with a notched portion (12), the thread handling portion (13) guiding the needle thread for introducing the latter into the notched portion (12), the pressure foot (5) being provided with a stationary blade (8) positioned in the guide passage and below the movable blade (9), the blade edge (9*a*) being engageable with the stationary blade (8) for cutting the needle thread, and the needle thread being clamped between the movable blade and the thread catching spring when the movable blade is moved from the thread trapping position to the thread clamping position.

5. The needle thread holding device as claimed in claim 4, wherein the needle thread releasing position comprises a standby position of the movable blade (9), and the thread clamping position comprises a thread cutting position of the movable blade (9).

6. The needle thread holding device as claimed in claim 1, wherein the sewing machine includes a bottom portion, and the needle thread holding device further comprising a pressure foot moving means, the pressure foot moving means comprising;

a shaft holder (31*a*, 31*b*) fixedly secured to the bottom portion (31);

a rotatable shaft (32) extending through the shaft holder, the rotatable shaft (32) being angularly rotatable in one direction for positioning the pressure foot (5) at the operative position and in another direction for positioning the pressure foot (5) at the non-operative position;

wing members (36*a*, 36*b*) provided integral with the rotatable shaft (32);

a knee pad supporting member integrally connected to the rotatable shaft (32) for rotating the rotatable shaft about its axis;

a biasing member (30) connected to the rotatable shaft (32) for normally biasing the rotatable shaft in the one direction;

an operation rod (39) slidably disposed in the bottom portion, the operation rod (39) having one end connected to the pressure foot (5) and another end abutable on one of the wing members (36*a*), the operation rod (39) having an ascent position in accordance with the rotation of the rotatable shaft in the other direction, and a descent position in accordance with the rotation of the rotatable shaft in the one direction.

7. The needle thread holding device as claimed in claim 6, wherein the pressure foot position detection means (41) comprises;

a switch table (40) stationarily coupled to the shaft holder (31*a*);

a microswitch (42) provided on the switch table (40);

cam means (44*a*,44*b*,44*c*) provided integral with the rotatable shaft (32), the microswitch (42) being abuttable on the cam means for generating the signal indicative of the non-operative position of the pressure foot (5).

8. A needle thread holding device in a sewing machine, the sewing machine including a needle for passing a needle thread therethrough and having an upper needle position and a lower needle position, workpiece supporting means (3*a*) for supporting a workpiece, a pressure foot (5) selectively moveable between an operative position for pressing the workpiece onto the workpiece supporting means and a non-operative position spaced away from the workpiece, sewing machine energization signal generating means (60,61) adapted to generate a sewing machine energization signal in accordance with a manipulation by an operator, a thread cutting unit for cutting thread stitched into the workpiece at a terminal phase of a sewing operation, and an improvement comprising:

holding means (7,9) provided within the pressure foot (5), the holding means being selectively movable between a needle thread clamping position (P3) for clamping a needle thread which has been cut by the cutting unit and a needle thread releasing position (P1) for releasing the cut needle thread;

drive means (M) connected to the holding means (7,9) for selectively moving the holding means to one of the needle thread releasing position (P1) and the needle thread clamping position (P3);

pressure foot position detection means (41) for detecting a position of the pressure foot (5) and generating a signal indicative of the non-operative position of the pressure foot; and control means (50) connected to the pressure foot position detection means (41) for maintaining the holding means (7,9) at its thread clamping position (P3) when the pressure foot (5) is at its non-operative position in accordance with a non-operative signal after cutting the needle thread.

9. The needle thread holding device as claimed in claim 8, wherein the thread cutting unit comprises a thread cutting blade positioned within the pressure foot.

* * * * *